US007189907B1

(12) United States Patent
Poulin et al.

(10) Patent No.: US 7,189,907 B1
(45) Date of Patent: Mar. 13, 2007

(54) NECK ASSEMBLY FOR AN ACOUSTIC GUITAR

(75) Inventors: Stéphane Poulin, Cookshire (CA); Daniel Picard, La Patrie (CA)

(73) Assignee: 117506 Canada Inc., Quebec (CA)

( * ) Notice: Subject to any disclaimer, the term of this patent is extended or adjusted under 35 U.S.C. 154(b) by 0 days.

(21) Appl. No.: 11/216,279

(22) Filed: Aug. 30, 2005

(51) Int. Cl.
*G10D 13/00* (2006.01)

(52) U.S. Cl. ..... 84/293

(58) Field of Classification Search ..... 84/293, 84/267, 290
See application file for complete search history.

(56) References Cited

U.S. PATENT DOCUMENTS

| | | | | |
|---|---|---|---|---|
| 1,074,458 | A | 9/1913 | Pileri | |
| 4,027,570 | A | 6/1977 | Rendell et al. | |
| 5,125,311 | A | 6/1992 | Boulanger et al. | |
| 6,051,766 | A | 4/2000 | Taylor | |
| 6,265,648 | B1 | 7/2001 | Steinberger | |
| 6,350,939 | B1 | 2/2002 | Griffiths | |
| 6,525,247 | B2 | 2/2003 | Griffifths | |
| 6,831,218 | B2 | 12/2004 | Steinberger | |
| 6,833,501 | B2 | 12/2004 | Jagmin | |
| 2003/0106409 | A1 * | 6/2003 | McPherson | 84/293 |

FOREIGN PATENT DOCUMENTS

| | | |
|---|---|---|
| WO | 88/00752 | 1/1998 |

* cited by examiner

*Primary Examiner*—Kimberly Lockett
(74) *Attorney, Agent, or Firm*—Fay Kaplun & Marcin, LLP

(57) ABSTRACT

A guitar neck assembly so configured as to be mounted to a guitar body via two types of attachment: an adhesive and mechanical fastener is described herein. The guitar neck includes a neck extension that is added after the neck angle with respect to the guitar body is adjusted.

14 Claims, 6 Drawing Sheets

NECK ASSEMBLY FOR AN ACOUSTIC GUITAR

FIELD OF THE INVENTION

The present invention relates to acoustic guitars. More specifically, the present invention is concerned with a neck assembly for an acoustic guitar.

BACKGROUND OF THE INVENTION

Acoustic guitars are well known. They usually include a hollow body to which a neck is attached. The neck usually defines an angle with respect to the guitar top to allow for a comfortable string action, i.e. the distance between the strings and the neck.

Many neck attachment techniques have been developed in the past.

A traditional neck attachment technique uses a so-called Spanish neck, i.e. a neck that is one piece from the head to the foot inside the body of the guitar. The sides of the guitar are glued into slots cut in the heel of the neck. This type of neck attachment results in a very rigid assembly. However, it is not well suited to contemporary manufacturing since the neck is attached to the body at the beginning of the construction of the instrument, making it too bulky.

Another long standing neck attachment technique consists of making a dovetail assembly between the neck and the body. Traditionally, a dovetail tenon is made in the neck and a corresponding dovetail mortise is made in the body. While this joint is also very strong, it is very difficult to disassemble and the neck angle may be difficult to adjust since there are many mating surfaces.

Guitar makers recently began using mechanical fasteners, such as machine screws and threaded inserts, to attach the neck to the body. Generally, two inserts are installed in the heel of the neck and the machine screws are inserted from the inside of the body to attach the neck. While this neck attachment provides a strong back to forth support of the neck, it has been remarked that the lateral support is less than optimal. Indeed, the mechanical fasteners are aligned with the centerline of the neck and body, giving poor lateral support.

OBJECTS OF THE INVENTION

An object of the present invention is therefore to provide an improved neck assembly for an acoustic guitar

SUMMARY OF THE INVENTION

More specifically, in accordance with an aspect of the present invention, there is provided a guitar neck assembly to be assembled to a guitar body having a neck receiving block provided with a generally rectangular channel; said guitar neck assembly comprising:

a guitar neck including a head portion, a heel portion and a central portion provided between said head portion and said heel portion; said central portion defining a fretboard receiving surface; said heel portion defining a guitar body contacting surface that defines, with said fretboard receiving surface, a predetermined angle; said guitar neck also includes a sloped channel opening on both said fretboard receiving surface and said guitar body contacting surface;

a neck extension having a generally pointed portion configured and sized as to be received within said sloped channel, and a generally rectangular projecting portion configured and sized to enter the generally rectangular channel of the neck receiving block;

wherein when said guitar neck assembly is assembled to the guitar body a) an adhesive is used to securely mount said rectangular projecting portion of said neck extension into the generally rectangular channel, and b) mechanical fasteners are used to securely mount said guitar body contacting surface of said heel to the guitar body.

In accordance with another aspect of the present invention, there is provided a guitar neck assembly comprising:

a guitar neck including a head portion, a heel portion and a central portion provided between said head portion and said heel portion; said central portion defining a fretboard receiving surface; said heel portion defining a guitar body contacting surface that defines, with said fretboard receiving surface, a predetermined angle; said guitar neck also includes a sloped channel opening on both said fretboard receiving surface and said guitar body contacting surface;

a neck extension having a generally pointed portion configured and sized as to be received within said sloped channel, and a generally rectangular projecting portion.

In accordance with another aspect of the present invention, there is provided a neck to body attachment method for a guitar comprising:

providing a guitar body having a neck receiving block provided with a generally rectangular channel;

providing a guitar neck including a head portion, a heel portion and a central portion provided between the head portion and the heel portion; the central portion defining a fretboard receiving surface; the heel portion defining a guitar body contacting surface;

shaping the guitar body contacting surface of the heel portion so that a) it defines, with said fretboard receiving surface, a predetermined angle, and b) it conforms to the shape of the neck receiving block area of the guitar body;

forming a sloped channel opening on both the fretboard receiving surface and the guitar body contacting surface;

providing a neck extension having a generally pointed portion configured and sized as to be received within the sloped channel, and a generally rectangular projecting portion;

mounting the generally pointed portion of the neck extension in the sloped channel of the guitar neck via an adhesive;

providing a fretboard;

mounting the fretboard to the fretboard receiving surface of the guitar neck via an adhesive;

mounting the guitar neck to the guitar body by inserting the generally rectangular projection of the neck extension into the generally rectangular channel of the guitar body and securing it therein via an adhesive; and installing mechanical fasteners between the neck receiving block of the guitar body and the heel portion of the guitar neck.

Other objects, advantages and features of the present invention will become more apparent upon reading of the following non-restrictive description of preferred embodiments thereof, given by way of example only with reference to the accompanying drawings.

DETAILED DESCRIPTION

Generally stated, the present invention relates to a guitar neck assembly so configured as to be mounted to a guitar body via two types of attachment: an adhesive and mechanical fastener. The guitar neck includes a neck extension that is added after the neck angle with respect to the guitar body is adjusted. The neck extension allows a better attachment between the neck and the guitar body while allowing the heel of the neck to be perfectly fitted to the guitar body before the neck extension is mounted to the neck.

Figure 1:
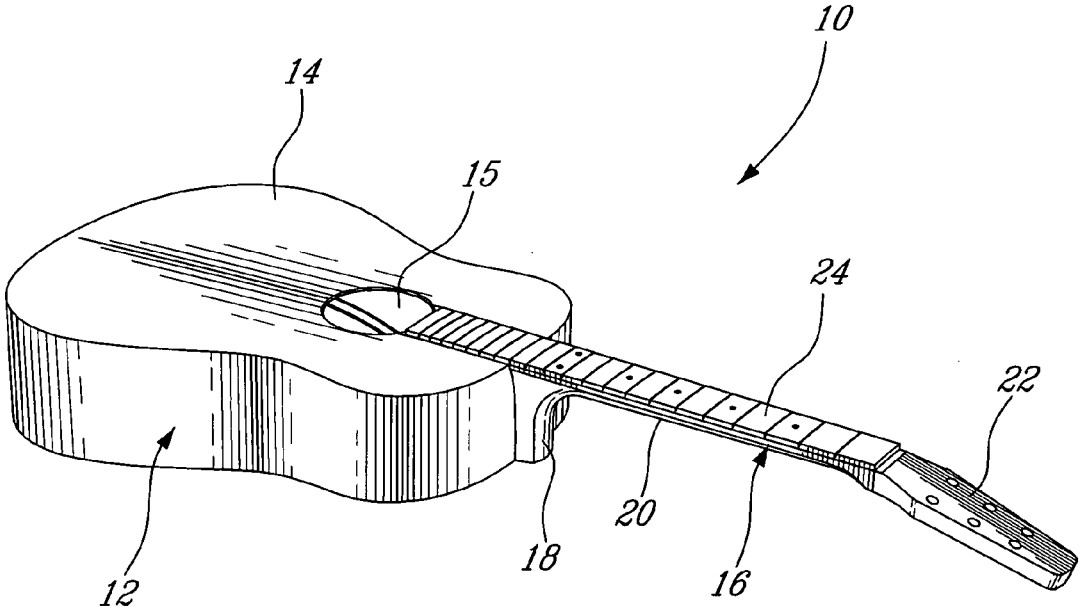
FIG. 1 is a perspective view of an acoustic guitar.

Turning now to FIG. 1 of the appended drawings, an acoustic guitar 10 includes a body 12 provided with a generally flat top 14 having a soundhole 15; a neck assembly 16 provided with a heel portion 18, a central portion 20 and a head portion 22; and a fretboard 24 secure to both the neck assembly 16 and to the top 14 via an adhesive (not shown).

Figure 2:
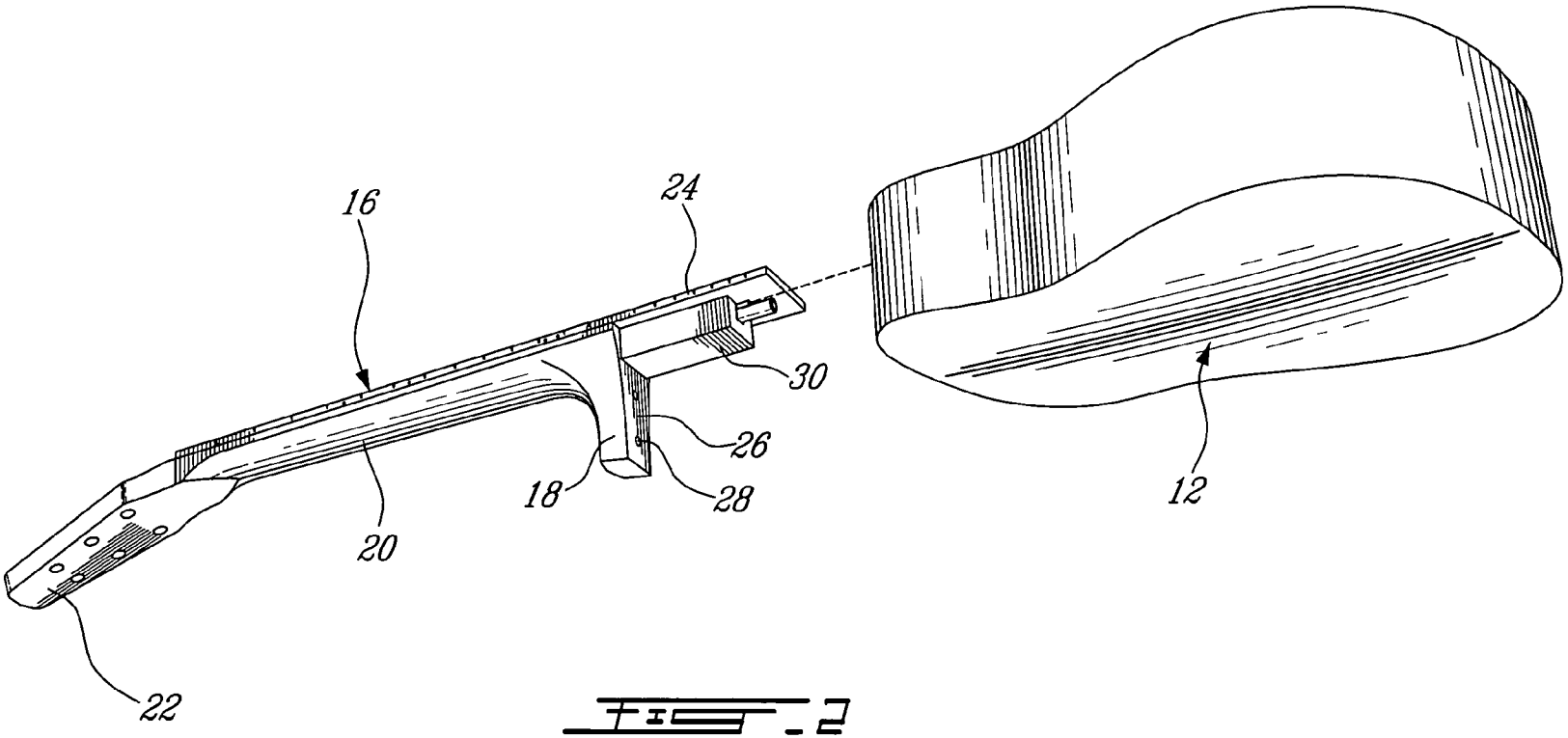
FIG. 2 is a perspective view of a completed neck ready to be attached to a completed guitar body.

The neck assembly 16 may be better seen from FIG. 2 which illustrates a completed neck 16 ready to be assembled to a guitar body 12. As can be seen from this figure, the heel portion 18 of the neck assembly 16 includes a guitar body contacting surface 26 provided with two internally threaded inserts 28. A generally rectangular neck extension 30 projects from the guitar body contacting surface 26 and is received within a corresponding rectangular neck extension receiving channel (not shown) opening to both the top 14 of the guitar body 12 and to the neck contacting surface of the body. The guitar body 12 conventionally includes an internal neck receiving block (not shown) reinforcing the guitar body 12 in the neck receiving area. This block is machined with the neck extension receiving channel.

When the neck assembly 16 is mounted to the guitar body 12, an adhesive such as glue is provided between the neck extension 30 and the corresponding channel to thereby provide a first means of attachment of the neck assembly 16 to the guitar body 12.

After the neck extension 30 is inserted inside the corresponding channel of the guitar body 12, mechanical fasteners such as machine screws (not shown) are inserted through the guitar body 12 into the inserts 28 of the heel, thereby ensuring an adequate contact between the guitar body contacting surface 26 of the heel and the neck contacting surface of the body 12. The mechanical fasteners and the inserts 28 provide a second means of attachment of the neck assembly 16 to the guitar body 12. Furthermore, the mechanical fasteners also act as clamps during the glue setting time.

Turning now to FIGS. 3A to 3G, the manufacture of a neck assembly according to an embodiment of the present invention will be described.

Figure 3A:
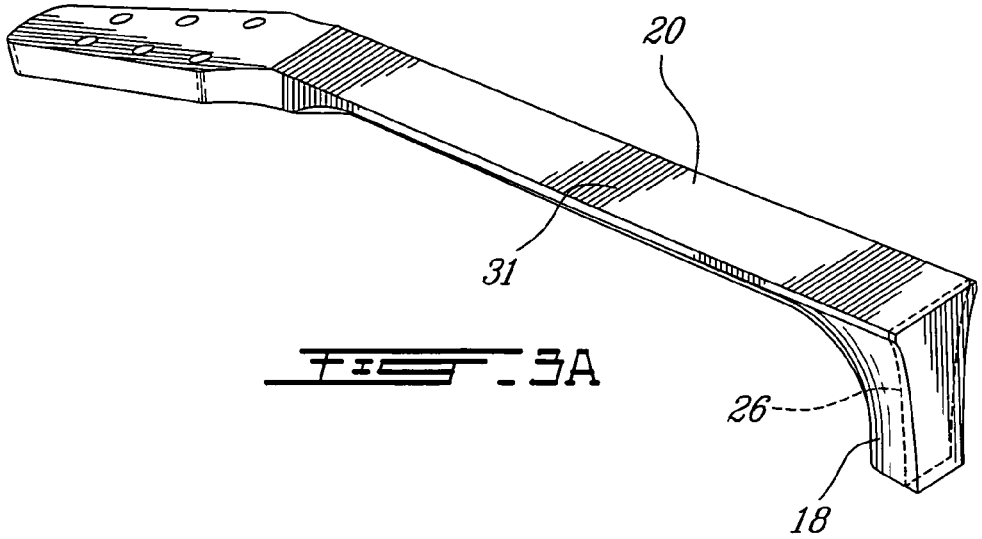
FIGS. 3A to 3G illustrate steps in the formation of a neck assembly according to an embodiment of the present invention.

FIG. 3A illustrates a neck blank before the shaping of the guitar body contacting surface of the heel 18. The goal is to first shape this surface so that it mates perfectly with the guitar body and that it projects at the correct angle with respect to the guitar top. Accordingly, the angle between the fretboard receiving surface 31 and the guitar body contacting surface 26 must be determined and shaped.

Figure 4:
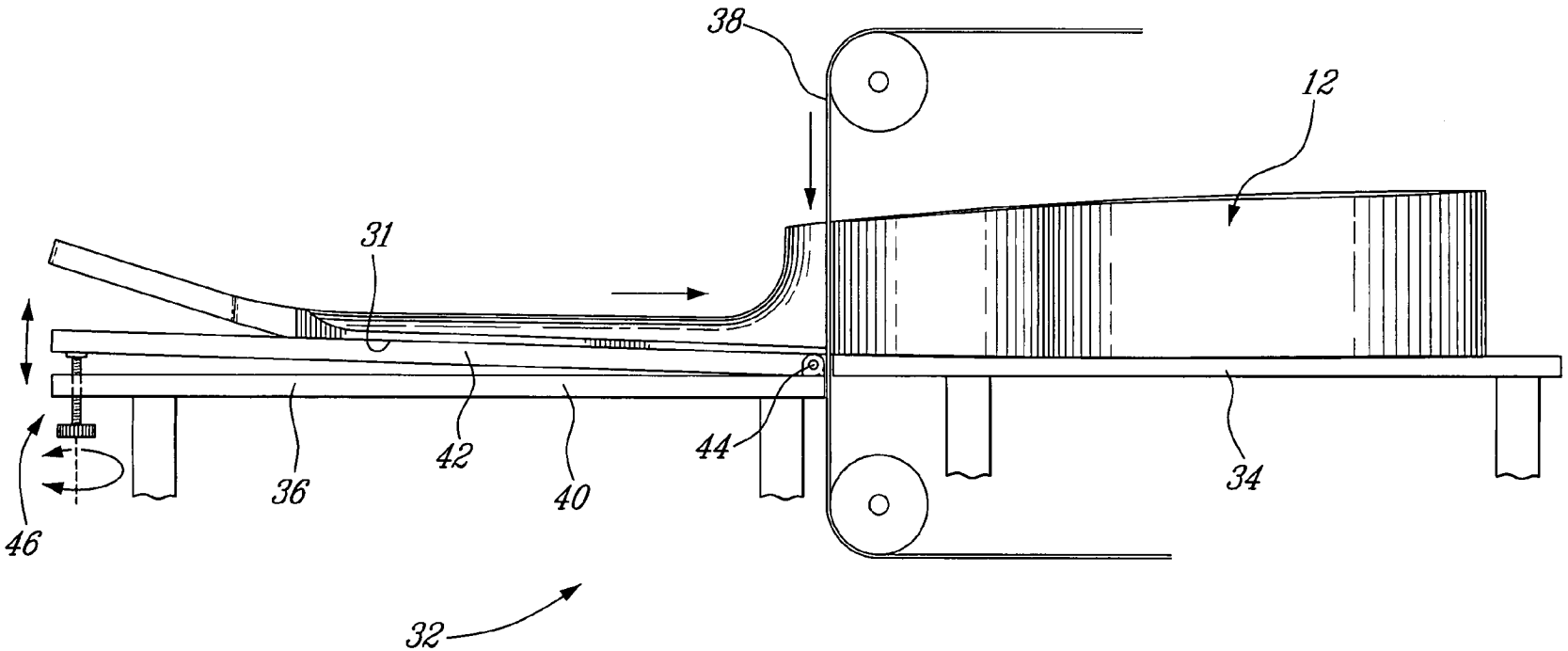
FIG. 4 is a schematic side elevation view of a machine used to produce the correct neck angle.

To shape the guitar body contacting surface 26, a machine 32 as schematically illustrated in FIG. 4 is used. The machine 32 is in fact a belt sander that uses the guitar body 12 as a backing surface, therefore ensuring that the neck 16 and the guitar body 12 will mate perfectly. The machine therefore includes a guitar body receiving table 34, a neck blank receiving table 36 and a belt sander 38. The tables 34 and 36 are height adjustable and the neck blank receiving table 36 is so designed that the angle between the fretboard receiving surface 31 and the belt sander 38 may be adjusted. The table 36 therefore includes a fixed portion 40 and a pivotable portion 42 mounted to the fixed portion 40 via a pivot pin 44. A tilting arrangement 46 allows the angle to be set. When the angle between the pivotable portion 42 and the belt sander 38 is set, the neck blank may be pushed against the belt sander 38 to adequately shape the body contacting surface 26.

It is to be noted that the precise shaping of the guitar body contacting surface 26 with the machine illustrated in FIG. 4 is possible since no part of the guitar neck projects beyond this surface at this stage.

Figure 3B:
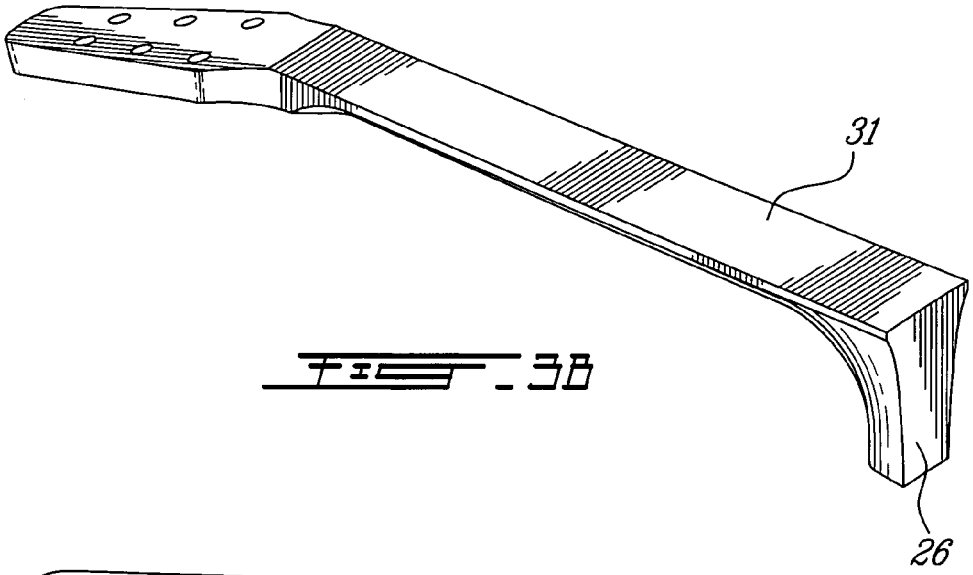

FIG. 3B illustrates the neck blank when the guitar body contacting surface 26 is shaped.

Figure 3C:
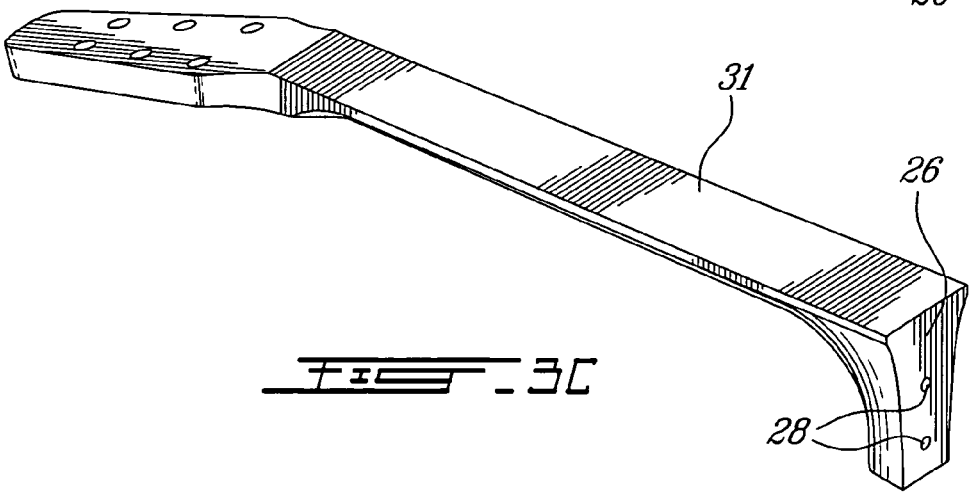

The next step is to drill the holes and install the inserts 28 in the guitar body contacting surface 26. To do this, the neck is advantageously maintained onto the table 36 to drill the holes at the adequate angle. The result of this step is illustrated in FIG. 3C.

Figure 3D:
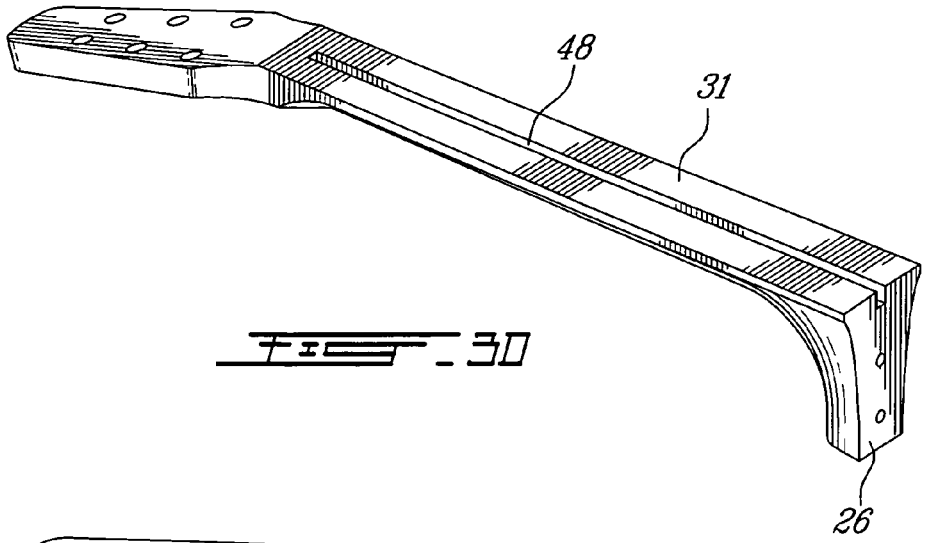

Next, a rectangular slot 48 is routed from the fretboard receiving surface 31. This slot is configured and sized to receive a conventional truss rod. FIG. 3D illustrates the neck blank provided with the truss rod slot 48.

Figure 3E:
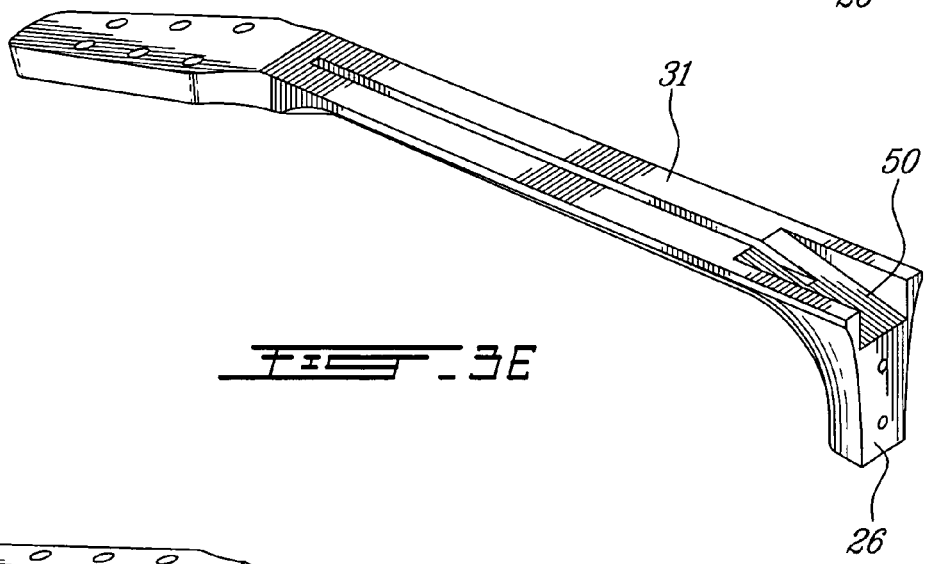

A sloped channel 50 is then machined into the neck blank (FIG. 3E). The sloped channel 50 is open to both the fretboard receiving surface 31 and to the guitar body contacting surface 26. The channel 50 may have a rectangular cross-section or may have a slightly dovetail cross-section.

Figure 3F:
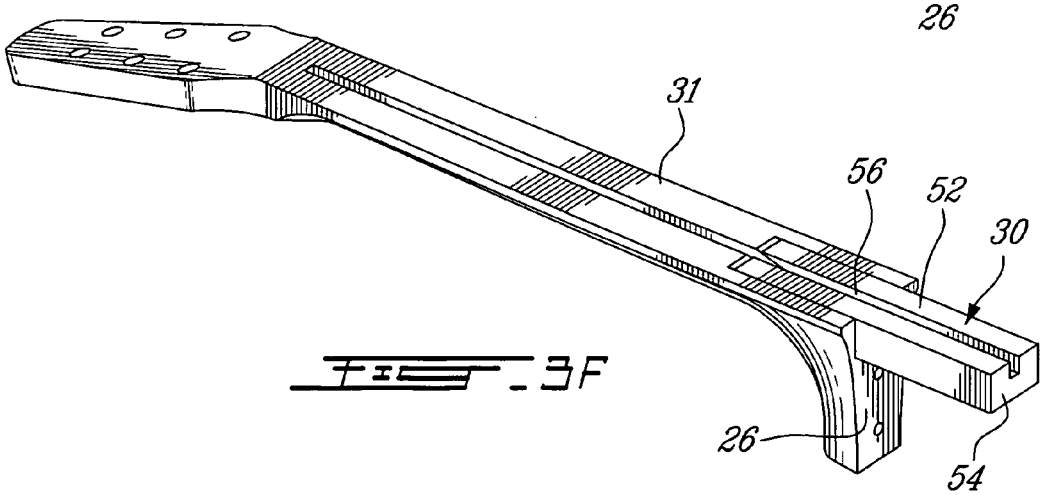

The neck extension 30 is then mounted to the sloped channel 50 (FIG. 3F). The neck extension 30 therefore has a pointed portion so configured and sized as to fit within the sloped channel 50 while the fretboard receiving surface 31 and the top surface 52 of the neck extension 30 are coplanar. The neck extension 30 also includes a generally rectangular projecting portion 54 configured and sized to enter a corresponding channel (not shown) in the guitar body 12. It is to be noted that the projecting portion of the neck extension may have a slightly dovetail cross section. It is also to be noted that the top surface 52 is provided with a truss rod slot 56.

Figure 3G:
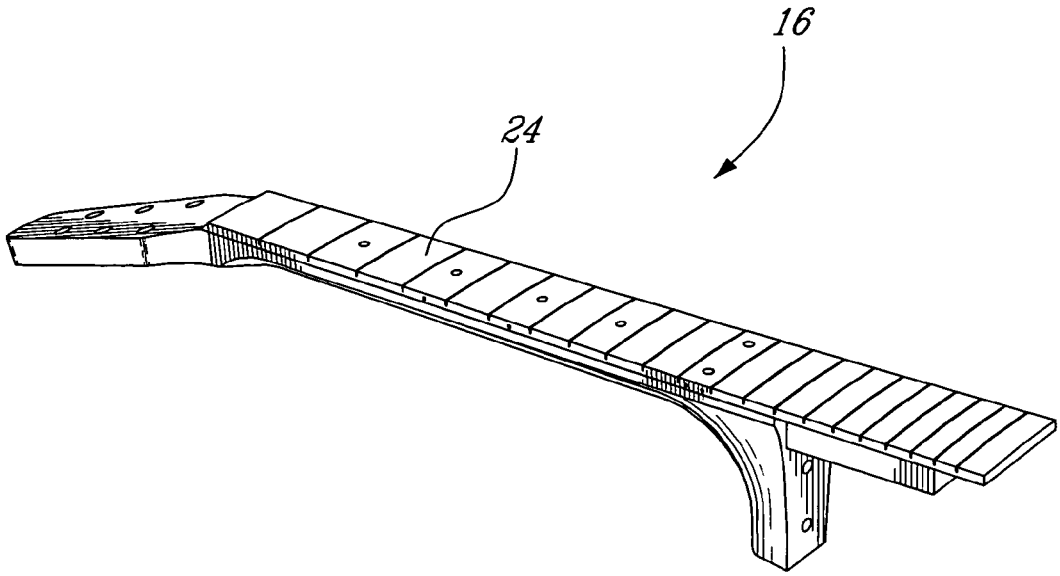

FIG. 3G illustrates a completed neck assembly 16. A fretboard 24 has been glued to the fretboard receiving surface 31 and to the top surface 52 of the neck extension 30. The neck assembly 16 is therefore ready to be mounted to the guitar body 12 as described hereinabove.

It is to be noted that while the above description was directed to a conventional and so-called "flat top acoustic guitar", other types of acoustic, semi-acoustic and electro-acoustic guitar with or without soundholes could be designed with a neck assembly as described herein.

Although the present invention has been described hereinabove by way of preferred embodiments thereof, it can be modified, without departing from the spirit and nature of the subject invention as defined in the appended claims.

What is claimed is:

1. A guitar neck assembly to be assembled to a guitar body having a neck receiving block provided with a generally rectangular channel; said guitar neck assembly comprising:

a guitar neck including a head portion, a heel portion and a central portion provided between said head portion and said heel portion; said central portion defining a fretboard receiving surface; said heel portion defining a guitar body contacting surface that defines, with said fretboard receiving surface, a predetermined angle; said guitar neck also includes a sloped channel opening on both said fretboard receiving surface and said guitar body contacting surface;

a neck extension having a generally pointed portion configured and sized as to be received within said sloped channel, and a generally rectangular projecting portion configured and sized to enter the generally rectangular channel of the neck receiving block;

wherein when said guitar neck assembly is assembled to the guitar body a) an adhesive is used to securely mount said rectangular projecting portion of said neck extension into the generally rectangular channel, and b) mechanical fasteners are used to securely mount said guitar body contacting surface of said heel to the guitar body.

2. The guitar neck assembly recited in claim 1, wherein the guitar body is an acoustic guitar body.

3. The guitar neck assembly recited in claim 1 further comprising a fretboard secured to said fretboard receiving surface of said guitar neck.

4. The guitar neck assembly recited in claim 1, wherein said generally rectangular projecting portion of said neck extension has a slightly dovetail cross-section.

5. The guitar neck assembly recited in claim 1, wherein said adhesive includes glue.

6. The guitar neck assembly recited in claim 1, wherein said mechanical fasteners include machine screws and threaded inserts.

7. A guitar neck assembly comprising:

a guitar neck including a head portion, a heel portion and a central portion provided between said head portion and said heel portion; said central portion defining a fretboard receiving surface; said heel portion defining a guitar body contacting surface that defines, with said fretboard receiving surface, a predetermined angle; said guitar neck also includes a sloped channel opening on both a portion of said fretboard receiving surface and said guitar body contacting surface;

a neck extension having a generally pointed portion configured and sized as to be received within said sloped channel, and a generally rectangular portion projecting from said guitar body contacting surface to enter a guitar body.

8. The guitar neck assembly recited in claim 7 further comprising a fretboard secured to said fretboard receiving surface of said guitar neck.

9. The guitar neck assembly recited in claim 7, wherein said generally rectangular projecting portion of said neck extension has a slightly dovetail cross-section.

10. A neck to body attachment method for a guitar comprising:

providing a guitar body having a neck receiving block provided with a generally rectangular channel;

providing a guitar neck including a head portion, a heel portion and a central portion provided between the head portion and the heel portion; the central portion defining a fretboard receiving surface; the heel portion defining a guitar body contacting surface;

shaping the guitar body contacting surface of the heel portion so that a) it defines, with said fretboard receiving surface, a predetermined angle, and b) it conforms to the shape of the neck receiving block area of the guitar body;

forming a sloped channel opening on both the fretboard receiving surface and the guitar body contacting surface;

providing a neck extension having a generally pointed portion configured and sized as to be received within the sloped channel, and a generally rectangular projecting portion;

mounting the generally pointed portion of the neck extension in the sloped channel of the guitar neck via an adhesive;

providing a fretboard;

mounting the fretboard to the fretboard receiving surface of the guitar neck via an adhesive;

mounting the guitar neck to the guitar body by inserting the generally rectangular projection of the neck extension into the generally rectangular channel of the guitar body and securing it therein via an adhesive; and installing mechanical fasteners between the neck receiving block of the guitar body and the heel portion of the guitar neck.

11. The neck to body attachment method recited in claim 10, wherein the guitar is an acoustic guitar.

12. The neck to body attachment method recited in claim 10, wherein said guitar body contacting surface of the heel portion shaping act includes determining the predetermined angle and sanding the guitar body contacting surface at the predetermined angle.

13. The neck to body attachment method recited in claim 10, wherein said neck extension providing act includes providing a neck extension so shaped that the generally rectangular projecting portion has a slightly dovetail cross-section.

14. The neck to body attachment method recited in claim 10, wherein said mechanical fasteners installing act includes installing machine screws and threaded inserts.

* * * * *